US011098266B2

(12) United States Patent
Bachmann et al.

(10) Patent No.: US 11,098,266 B2
(45) Date of Patent: Aug. 24, 2021

(54) ORGANIC COMPOUNDS

(71) Applicant: Givaudan SA, Vernier (CH)

(72) Inventors: Jean-Pierre Bachmann, Wädenswil (CH); Felix Flachsmann, Duebendorf (CH)

(73) Assignee: Givaudan SA

( * ) Notice: Subject to any disclaimer, the term of this patent is extended or adjusted under 35 U.S.C. 154(b) by 0 days.

(21) Appl. No.: 16/767,644

(22) PCT Filed: Dec. 5, 2018

(86) PCT No.: PCT/EP2018/083697
§ 371 (c)(1),
(2) Date: May 28, 2020

(87) PCT Pub. No.: WO2019/110690
PCT Pub. Date: Jun. 13, 2019

(65) Prior Publication Data

US 2020/0369981 A1 Nov. 26, 2020

(30) Foreign Application Priority Data

Dec. 7, 2017 (GB) ..... 1720380

(51) Int. Cl.
*C11B 9/00* (2006.01)

(52) U.S. Cl.
CPC ..... *C11B 9/0015* (2013.01)

(58) Field of Classification Search
None
See application file for complete search history.

(56) References Cited

U.S. PATENT DOCUMENTS 4,395,370 A * 7/1983 Boden ..... C07C 45/46 424/69
4,485,019 A 11/1984 Boden et al.
4,536,299 A 8/1985 Wiegers et al.
5,100,872 A 3/1992 Narula et al.
5,501,862 A 3/1996 Christenson
6,458,987 B1 10/2002 Storet

FOREIGN PATENT DOCUMENTS

DE 1293153 B 4/1969
GB 1153626 A 5/1969
JP 2000-355696 A 12/2000
WO WO 2011/132098 A1 4/2011

OTHER PUBLICATIONS

PCT/EP2018/083697—International Search Report, dated Mar. 21, 2019.
PCT/EP2018/083697—International Written Opinion, dated Mar. 21, 2019.
Wright, et al., "Juvenile Hormone Activity of Citronellylamine and Citronellol Derivatives Against Pupae on the Stable Fly and the House Fly *Diptera muscidae*", Journal of Medical Entomology, vol. 10, No. 5, Oct. 8, 1973, pp. 477-480.
Schving, et al., "N° 86. Sur quelques ethers mixtes d'alcools employes en parfumerie", Bulletin De La Societe Chimique De France, vol. 43, May 17, 1928, pp. 857-859.
Sonnet, et al., "Compounds related to juvenile hormones. IX. Activity of citronellylamine and citronellol derivatives on the yellow mealworm and the large milkweed bug", Journal of Agricultural and Food Chemistry, vol. 20, No. 1, 1972, pp. 65-69.
Mutlu, et al., "TBD catalysis with dimethyl carbonate: a fruitful and sustainable alliance", Green Chemistry, vol. 14, 2012, pp. 1728-1735.

* cited by examiner

*Primary Examiner* — Arrie L Reuther
(74) *Attorney, Agent, or Firm* — Curatolo Sidoti Co., LPA; Salvatore A. Sidoti; Floyd Trillis, III

(57) ABSTRACT

The present invention refers to 3,7-dimethyloct-6-en-1-yl methyl carbonate and its use as fragrance ingredient. The invention further refers to fragrance compositions and fragranced articles including it.

11 Claims, No Drawings

ORGANIC COMPOUNDS

CROSS REFERENCE TO RELATED APPLICATIONS

This application is a national stage application of International Application No. PCT/EP2018/083697, filed 5 Dec. 2018, which claims priority from Great Britain Patent Application No. 1720380.3, filed 7 Dec. 2017, both of which applications are incorporated herein by reference in their entireties.

The present invention relates to 3,7-dimethyloct-6-en-1-yl methyl carbonate (citronellyl methyl carbonate) as perfume ingredient possessing a strong fruity-rosy odor note. This invention relates furthermore to fragrance compositions and fragranced articles comprising it.

In the fragrance industry there is a constant demand for new compounds that enhance, modify or improve on odor notes. Surprisingly, it has now been found that 3,7-dimethyloct-6-en-1-yl methyl carbonate constitutes a valuable fruity-rosy odorant.

Whereas 3,7-dimethyloct-6-en-1-yl carbonates are reported in the literature, to the best of our knowledge, for none of them it has been reported or suggested any organoleptical properties, or any use as fragrance ingredient. 3,7-Dimethyloct-6-en-1-yl methyl carbonate, -ethyl carbonate and -phenyl carbonate are, for example, reported by Sonnet et al. (in *J. AGR. FOOD CHEM.*, VOL. 20, NO. 1, 1972, 65-69) as compounds exhibiting juvenile hormone activity on the yellow mealworm.

Surprisingly it was found that the 3,7-dimethyloct-6-en-1-yl methyl carbonate not only possesses very natural, strong fruity-rosy odor characteristics, but also possesses a significant lower odor detection threshold, compared to 3,7-dimethyloct-6-en-1-yl acetate and 3,7-dimethyloct-6-en-1-yl ethyl carbonate.

As used herein, "odor threshold value" means the lowest concentration of a volatile organic compound in air which can be detected by smell. Generally speaking, it can be said that a compound with a low odor threshold value is more powerful than a compound with a high odor threshold value and thus allows the use of very low concentration in a fragrance composition to achieve an olfactory effect.

There is provided in a first embodiment the use as fragrance of 3,7-dimethyloct-6-en-1-yl methyl carbonate.

In a further embodiment there is provided fragrance compositions comprising 3,7-dimethyloct-6-en-1-yl methyl carbonate as fragrance ingredient, and at least one additional fragrance ingredient.

Despite the fact that 3,7-dimethyloct-6-en-1-yl methyl carbonate possesses a very natural fruity-rosy, peal like odor characteristic, the odor profile can be even improved by the addition of a compound selected from 3,7-dimethyloct-7-en-1-yl methyl carbonate, 3,7-dimethylocta-2,6-dien-1-yl methyl carbonate ((E) and (Z)), and methyl phenethyl carbonate, and mixtures thereof.

Thus there is provided in a further aspect a fragrance composition comprising a) 3,7-dimethyloct-6-en-1-yl methyl carbonate; and b) at least one compound selected from 3,7-dimethyloct-7-en-1-yl methyl carbonate, (E)-3,7-dimethylocta-2,6-dien-1-yl methyl carbonate (geranyl methyl carbonate), (Z)-3,7-dimethylocta-2,6-dien-1-yl methyl carbonate (neryl methyl carbonate) and methyl phenethyl carbonate, and mixtures thereof.

As a specific, non-limiting example one may cite a fragrance composition comprising 3,7-dimethyloct-6-en-1-yl methyl carbonate and 3,7-dimethylocta-2,6-dien-1-yl methyl carbonate (e.g. (E)-3,7-dimethylocta-2,6-dien-1-yl methyl carbonate), e.g., in a ratio of 1:1 to 95:5 (3,7-dimethyloct-6-en-1-yl methyl carbonate:3,7-dimethylocta-2,6-dien-1-yl methyl carbonate).

As a further example one may cite a fragrance composition comprising 3,7-dimethyloct-6-en-1-yl methyl carbonate, 3,7-dimethyloct-7-en-1-yl methyl carbonate, 3,7-dimethylocta-2,6-dien-1-yl methyl carbonate, and methyl phenethyl carbonate. Said mixture provides a very natural fruity floral odor characteristics reminiscent of rose petals and pear and thus was from an olfactive view point preferred by perfumers, compared to the use of 3,7-dimethyloct-7-en-1-yl methyl carbonate alone.

There is provided in a further aspect a fragrance composition comprising a mixture consisting essentially of 50-95 weight % of 3,7-dimethyloct-6-en-1-yl methyl carbonate, 5-50 weight % of 3,7-dimethylocta-2,6-dien-1-yl methyl carbonate, up to 20 weight % of 3,7-dimethyloct-7-en-1-yl methyl carbonate, and up to 20 weight % of methyl phenethyl carbonate.

As a further specific example, one may cite, a fragrance composition comprising a mixtures consisting essentially of 60-80 weight % (e.g., about 76 weight %) of 3,7-dimethyloct-6-en-1-yl methyl carbonate, 15-25 weight % (e.g., about 21 weight %) of 3,7-dimethylocta-2,6-dien-1-yl methyl carbonate, 0.1-5 weight % (e.g., about 1.5 weight %) of 3,7-dimethyloct-7-en-1-yl methyl carbonate, and 0.5-5 weight % (e.g., about 1.5 weight %) of methyl phenethyl carbonate.

Citronellyl- and 3,7-dimethyloct-7-en-1-yl methyl carbonate comprise one chiral center and as such may exist as a mixture of stereoisomers, or it may be resolved as isomerically pure forms. Resolving stereoisomers adds to the complexity of manufacture and purification of these compounds and so it is preferred to use the compounds as mixtures of their stereoisomers simply for economic reasons. However, if it is desired to prepare individual stereoisomers, this may be achieved according to methods known in the art, e.g. preparative HPLC and GC, crystallization or stereoselective synthesis.

3,7-Dimethyloct-6-en-1-yl methyl carbonate may be used alone, as stereoisomeric mixture, or in combination with a base material. As used herein, the 'base material' includes all known odorant molecules selected from the extensive range of natural products, and synthetic molecules currently available, such as essential oils, alcohols, aldehydes and ketones, ethers and acetals, esters and lactones, macrocycles and heterocycles, and/or in admixture with one or more ingredients or excipients conventionally used in conjunction with odorants in fragrance compositions, for example, carrier materials, and other auxiliary agents commonly used in the art.

As used herein, "carrier material" means a material which is practically neutral from a odorant point of view, i.e. a material that does not significantly alter the organoleptic properties of odorants.

The term "auxiliary agent" refers to ingredients that might be employed in a fragrance composition for reasons not specifically related to the olfactive performance of said composition. For example, an auxiliary agent may be an ingredient that acts as an aid to processing a fragrance ingredient or ingredients, or a composition containing said ingredient(s), or it may improve handling or storage of a fragrance ingredient or composition containing same. It might also be an ingredient that provides additional benefits such as imparting color or texture. It might also be an ingredient that imparts light resistance or chemical stability to one or more ingredients contained in a fragrance composition. A detailed description of the nature and type of adjuvants commonly used in fragrance compositions containing same cannot be exhaustive, but it has to be mentioned that said ingredients are well known to a person skilled in the art.

As used herein, 'fragrance composition' means any composition comprising 3,7-dimethyloct-6-en-1-yl methyl carbonate and a base material, e.g. a diluent conventionally used in conjunction with odorants, such as diethyl phthalate (DEP), dipropylene glycol (DPG), isopropyl myristate (IPM), triethyl citrate (TEC) and alcohol (e.g. ethanol). Optionally, the composition may comprise an anti-oxidant adjuvant. Said anti-oxidant may be selected from Tinogard® TT (BASF), Tinogard® Q (BASF), Tocopherol (including its isomers, CAS 59-02-9; 364-49-8; 18920-62-2; 121854-78-2), 2,6-bis(1,1-dimethylethyl)-4-methylphenol (BHT, CAS 128-37-0) and related phenols, hydroquinones (CAS 121-31-9).

The following list comprises examples of known odorant molecules, which may be combined with the compound of the present invention:

- essential oils and extracts, e.g. castoreum, costus root oil, oak moss absolute, geranium oil, tree moss absolute, basil oil, fruit oils, such as bergamot oil and mandarine oil, myrtle oil, palmarose oil, patchouli oil, petitgrain oil, jasmine oil, rose oil, sandalwood oil, wormwood oil, lavender oil and/or ylang-ylang oil;
- alcohols, e.g. cinnamic alcohol ((E)-3-phenylprop-2-en-1-ol); cis-3-hexenol ((Z)-hex-3-en-1-ol); citronellol (3,7-dimethyloct-6-en-1-ol); dihydro myrcenol (2,6-dimethyloct-7-en-2-ol); Ebanol™ ((E)-3-methyl-5-(2,2,3-trimethylcyclopent-3-en-1-yl)pent-4-en-2-ol); eugenol (4-allyl-2-methoxyphenol); ethyl linalool ((E)-3,7-dimethylnona-1,6-dien-3-ol); farnesol ((2E,6Z)-3,7,11-trimethyldodeca-2,6,10-trien-1-ol); geraniol ((E)-3,7-dimethylocta-2,6-dien-1-ol); Super Muguet™ ((E)-6-ethyl-3-methyloct-6-en-1-ol); linalool (3,7-dimethylocta-1,6-dien-3-ol); menthol (2-isopropyl-5-methylcyclohexanol); Nerol (3,7-dimethyl-2,6-octadien-1-ol); phenyl ethyl alcohol (2-phenylethanol); Rhodinol™ (3,7-dimethyloct-6-en-1-ol); Sandalore™ (3-methyl-5-(2,2,3-trimethylcyclopent-3-en-1-yl)pentan-2-ol); terpineol (2-(4-methylcyclohex-3-en-1-yl)propan-2-ol); or Timberol™ (1-(2,2,6-trimethylcyclohexyl)hexan-3-ol); 2,4,7-trimethylocta-2,6-dien-1-ol, and/or [1-methyl-2(5-methylhex-4-en-2-yl)cyclopropyl]-methanol;
- aldehydes and ketones, e.g. anisaldehyde (4-methoxybenzaldehyde); alpha amyl cinnamic aldehyde (2-benzylideneheptanal); Georgywood™ (1-(1,2,8,8-tetramethyl-1,2,3,4,5,6,7,8-octahydronaphthalen-2-yl) ethanone); Hydroxycitronellal (7-hydroxy-3,7-dimethyloctanal); Iso E Super® (1-(2,3,8,8-tetramethyl-1,2,3,4,5,6,7,8-octahydronaphthalen-2-yl) ethanone); Isoraldeine® ((E)-3-methyl-4-(2,6,6-trimethylcyclohex-2-en-1-yl)but-3-en-2-one); Hedione® (methyl 3-oxo-2-pentylcyclopentaneacetate); 3-(4-isobutyl-2-methylphenyl)propanal; maltol; methyl cedryl ketone; methylionone; verbenone; and/or vanillin;
- ether and acetals, e.g. Ambrox® (3a,6,6,9a-tetramethyl-2,4,5,5a,7,8,9,9b-octahydro-1H-benzo[e][1]benzofuran); geranyl methyl ether ((2E)-1-methoxy-3,7-dimethylocta-2,6-diene); rose oxide (4-methyl-2-(2-methylprop-1-en-1-yl)tetrahydro-2H-pyran); and/or Spirambrene® (2',2',3,7,7-pentamethylspiro[bicyclo[4.1.0]heptane-2,5'-[1,3]dioxane]);
- esters and lactones, e.g. benzyl acetate; cedryl acetate ((1S,6R,8aR)-1,4,4,6-tetramethyloctahydro-1H-5,8a-methanoazulen-6-yl acetate); γ-decalactone (6-pentyltetrahydro-2H-pyran-2-one); Helvetolide® (2-(1-(3,3-dimethylcyclohexyl)ethoxy)-2-methylpropyl propionate); γ-undecalactone (5-heptyloxolan-2-one); and/or vetiveryl acetate ((4,8-dimethyl-2-propan-2-ylidene-3,3a,4,5,6,8a-hexahydro-1H-azulen-6-yl) acetate);
- macrocycles, e.g. Ambrettolide ((Z)-oxacycloheptadec-10-en-2-one); ethylene brassylate (1,4-dioxacycloheptadecane-5,17-dione); and/or Exaltolide® (16-oxacyclohexadecan-1-one); and
- heterocycles, e.g. isobutylquinoline (2-isobutylquinoline).

Further examples of known fragrance ingredients with which 3,7-dimethyloct-6-en-1-yl methyl carbonate may be combined include 6-methoxy-2,6-dimethylheptan-1-al (Methoxymelonal); 5,9-dimethyl-4,8-decadienal (Geraldehyde); octahydro-8,8-dimethylnaphthalene-2-carbaldehyde (Cyclomyral); 5-methyl-2-(1-methylbutyl)-5-propyl-1,3-dioxan (Troenan); 3,7,11-trimethyldodeca-1,6,10-trien-3-ol (optionally as an isomeric mixture) (Nerolidol); 2-methyl-4-phenylbutan-2-ol (dimethylphenylethylcarbinol); 1-(1-hydroxyethyl)-4-(1-methylethyl)cyclohexane (optionally as a mixture of the diastereoisomers) (Mugetanol); (4-methyl-3-pentenyl)cyclohexenecarbaldehyde (Citrusal); 3-(p-(2-methylpropyl)phenyl)-2-methylpropionaldehyde (Silvial); 3-p-cumenyl-2-methylpropionaldehyde (Cyclamenaldehyde); and mixtures of: cis-tetrahydro-2-isobutyl-4-methylpyran-4-ol and trans-tetrahydro-2-isobutyl-4-methylpyran-4-ol.

Even further examples of known fragrance ingredients may include Amyl Salicylate (pentyl 2-hydroxybenzoate); Aurantiol® ((E)-methyl 2-((7-hydroxy-3,7-dimethyloctylidene)amino)benzoate); Benzyl Salicylate (benzyl 2-hydroxybenzoate); Cis-3-hexenyl Salicylate ((Z)-hex-3-en-1-yl 2-hydroxybenzoate); Citronellyl Oxyacetaldehyde (2-((3,7-dimethyloct-6-en-1-yl)oxy)acetaldehyde); Cyclemax (3-(4-propan-2-ylphenyl)propanal); Cyclohexyl Salicylate (cyclohexyl 2-hydroxybenzoate); Cyclomyral® (8,8-dimethyl-1,2,3,4,5,6,7,8-octahydronaphthalene-2-carbaldehyde); Cyclopentol (2-pentylcyclopentan-1-01); Cymal (4-(4-hydroxy-4-methylpentyl)cyclohex-3-enecarbaldehyde); Dupical ((E)-4-((3a5,7a5)-hexahydro-1H-4,7-methanoinden-5(6H)-ylidene)butanal); Floral Super ((4E)-4,8-dimethyldeca-4,9-dienal); Florhydral® (3-(3-isopropylphenyl)butanal); Florol® (2-isobutyl-4-methyltetrahydro-2H-pyran-4-ol); Gyrane (2-butyl-4,6-dimethyl-3,6-dihydro-2H-pyran); Hexyl Salicylate (hexyl 2-hydroxybenzoate); Helional (3-(1,3-benzodioxol-5-yl)-2-methylpropanal); Lyral® (4-(4-hydroxy-4-methylpentyl)cyclohex-3-enecarbaldehyde); Majantol® (2,2-dimethyl-3-(m-tolyl)propan-1-ol); Mayol® ((4-isopropylcyclohexyl)-methanol); Melafleur (8,8-dimethyl-2,3,4,5,6,7-hexahydro-1H-naphthalene-2-carbaldehyde); Melonal (2,6-dimethylhept-5-enal); Muguesia (3-methyl-4-phenylbutan-2-ol); Muguet alcohol (3-cyclohexyl-2,2-dimethylpropan-1-ol); Verdantiol ((E)-methyl 2-((3-(4-(tert-butyl)phenyl)-2-methylprop-1-en-1-yl)amino) benzoate); Peonile (2-cyclohexylidene-2-phenylacetonitrile); Phenoxanol® (3-methyl-5-phenylpentan-1-ol); Rossitol® (3-isobutyl-1-methylcyclohexanol); Suzaral (2-methyl-3-[4-(2-methylpropyl)phenyl]propanal); Muguol® (3,7-dimethylocta-4,6-dien-3-ol); Tetrahydro Linalool (3,7-dimethyloctan-3-ol); Acalea ((2E)-2-[(4-methylphenyl)

methylidene]-heptanal); Dihydro IsoJasmonate (methyl 2-hexyl-3-oxocyclopentane-1-carboxylate); Hexyl Cinnamic Aldehyde ((E)-2-benzylideneoctanal); Acetoin (3-hydroxybutan-2-one); Adoxal (2,6,10-trimethylundec-9-enal); Aldolone® (7-propyl-2H-1,5-benzodioxepin-3(4H)-one); Ambrocenide® ((4aR,5R,7aS,9R)-Octahydro-2,2,5,8,8,9a-hexamethyl-4H-4a,9-methanoazuleno[5,6-d]-1,3-dioxole); Ambroxan (3a,6,6,9a-tetramethyl-2,4,5,5a,7,8,9,9b-octahydro-1H-benzo[e][1]benzofuran); Bacdanol® ((E)-2-ethyl-4-(2,2,3-trimethylcyclopent-3-en-1-yl)but-2-en-1-ol); Calone 1951° (7-methyl-2H-benzo[b][1,4]dioxepin-3(4H)-one); Cetalox® (3a,6,6,9a-tetramethyl-2,4,5,5a,7,8,9,9b-octahydro-1H-benzo[e][1]benzofuran); Cinnamic alcohol ((E)-3-phenylprop-2-en-1-ol); Citral ((E)-3,7-dimethyloct-2,6-dienal); Cyclabute ((3aR,6S,7aS)-3a,4,5,6,7,7a-hexahydro-1H-4,7-methanoinden-6-ylisobutyrate); Cyclacet™ ((3aR,6S,7aS)-3a,4,5,6,7,7a-hexahydro-1H-4,7-methanoinden-6-yl acetate); Cyclaprop ((3aR,6S,7aS)-3a,4,5,6,7,7a-hexahydro-1H-4,7-methanoinden-6-yl propionate); Cyclohexadecanolide; Cyclohexadecenone; Cyclopentadecanone; Delta Damascone ((E)-1-(2,6,6-trimethylcyclohex-3-en-1-yl)but-2-en-1-one); Elintaal Forte (3-(1-ethoxyethoxy)-3,7-dimethylocta-1,6-diene); Ethyl Vanillin (3-ethoxy-4-hydroxybenzaldehyde); Exaltenone ((4Z)-cyclopentadec-4-en-1-one); Floralozone (3-(4-ethylphenyl)-2,2-dimethylpropanal); Fructalate (diethyl cyclohexane-1,4-dicarboxylate); Habanolide ((E)-oxacyclohexadec-12-en-2-one); Galaxolide (4,6,6,7,8,8-hexamethyl-1,3,4,6,7,8-hexahydro-cyclopenta[g]isochromene); Hydroxyambran® (2-cyclododecylpropan-1-01); Myraldene (4-(4-methylpent-3-en-1-yl)cyclohex-3-enecarbaldehyde); Jasmal (3-pentyltetrahydro-2H-pyran-4-yl acetate); Javanol® ((1-methyl-2-((1,2,2-trimethylbicyclo[3.1.0]hexan-3-yl)methyl) cyclopropyl)methanol); Lauric Aldehyde (Dodecanal); Mefranal (3-methyl-5-phenylpentanal); Muscenone ((Z)-3-methylcyclopentadec-5-enone); Tonalid® (1-(3,5,5,6,8,8-hexamethyl-5,6,7,8-tetrahydronaphthalen-2-yl)ethanone); Nectaryl® (2-(2-(4-methylcyclohex-3-en-1-yl)propyl)cyclopentanone); Norlimbanol (1-(2,2,6-trimethylcyclohexyl) hexan-3-ol); Raspberry ketone (4-(4-hydroxyphenyl)butan-2-one); Pinoacetaldehyde (3-(6,6-dimethylbicyclo[3.1.1] hept-2-en-2-yl)propanal); Romandolide® (acetic acid (1-oxopropoxy)-, 1-(3,3-dimethyl cyclohexyl)ethyl ester); Sanjinol ((E)-2-ethyl-4-(2,2,3-trimethylcyclopent-3-en-1-yl)but-2-en-1-ol); and/or Velvione® ((Z)-cyclohexadec-5-enone).

A fragrance composition need not be limited to the fragrance ingredients listed above. Other fragrance ingredients commonly used in perfumery may be employed, for example any of those ingredients described in "Perfume and Flavour Chemicals", S. Arctander, Allured Publishing Corporation, 1994, IL, USA, which is incorporated herein by reference, including essential oils, plant extracts, absolutes, resinoids, odorants obtained from natural products and the like.

3,7-Dimethyloct-6-en-1-yl methyl carbonate may be used in a broad range of fragranced articles, e.g. in any field of fine and functional perfumery, such as perfumes, air care products, household products, laundry products, body care products and cosmetics. The compound can be employed in widely varying amounts, depending upon the specific article and on the nature and quantity of other odorant ingredients. The proportion is typically from 0.0001 to 30 weight percent of the article. In one embodiment, the compound of the present invention may be employed in a fabric softener in an amount from 0.001 to 0.3 weight percent (e.g. 0.01 to 0.1 including 0.05 weight %). In another embodiment, the compound of the present invention may be used in fine perfumery in amounts from 0.01 to 30 weight percent (e.g. up to about 10 or up to 20 weight percent), more preferably between 0.01 and 5 weight percent. However, these values are given only by way of example, since the experienced perfumer may also achieve effects or may create novel accords with lower or higher concentrations.

3,7-Dimethyloct-6-en-1-yl methyl carbonate may be employed in a consumer product base simply by directly mixing the said compound, or a fragrance composition comprising the 3,7-dimethyloct-6-en-1-yl methyl carbonate with the consumer product base, or it may, in an earlier step, be entrapped with an entrapment material, for example, polymers, capsules, microcapsules and nanocapsules, liposomes, film formers, absorbents such as carbon or zeolites, cyclic oligosaccharides and mixtures thereof, or it may be chemically bonded to substrates, which are adapted to release 3,7-dimethyloct-6-en-1-yl methyl carbonate upon application of an external stimulus such as light, enzyme, oxygen, or the like, and then mixed with the consumer product base.

Thus, the invention additionally provides a method of manufacturing a fragranced article, comprising the incorporation of 3,7-dimethyloct-6-en-1-yl methyl carbonate, as a fragrance ingredient, either by directly admixing the compound to the consumer product base or by admixing a fragrance composition comprising 3,7-dimethyloct-6-en-1-yl methyl carbonate, which may then be mixed with a consumer product base, using conventional techniques and methods. Through the addition of an olfactory acceptable amount of the compound of the present invention as hereinabove described the odor notes of a consumer product base will be improved, enhanced, or modified.

Thus, the invention furthermore provides a method for improving, enhancing or modifying a consumer product base by means of the addition thereto of an olfactorily acceptable amount of 3,7-dimethyloct-6-en-1-yl methyl carbonate.

The invention also provides a fragranced article comprising:

a) 3,7-Dimethyloct-6-en-1-yl methyl carbonate;
b) optionally at least one compound selected from 3,7-dimethyloct-7-en-1-yl methyl carbonate, (E)-3,7-dimethylocta-2,6-dien-1-yl methyl carbonate, (Z)-3,7-dimethylocta-2,6-dien-1-yl methyl carbonate and methyl phenethyl carbonate, and mixtures thereof; and
c) a consumer product base.

As used herein, 'consumer product base' means a composition for use as a consumer product to fulfill specific actions, such as cleaning, softening, and caring or the like. Examples of such products include fine perfumery, e.g. perfume and eau de toilette; fabric care, household products and personal care products such as cosmetics, laundry care detergents, rinse conditioner, personal cleansing composition, detergent for dishwasher, surface cleaner; laundry products, e.g. softener, bleach, detergent; body-care products, e.g. shampoo, shower gel; air care products (includes products that contain preferably volatile and usually pleasant-smelling compounds which advantageously can even in very small amounts mask unpleasant odors). Air fresheners for living areas contain, in particular, natural and synthetic essential oils such as pine needle oils, citrus oil, *eucalyptus* oil, lavender oil, and the like, in amounts for example of up to 50% by weight. As aerosols they tend to contain smaller amounts of such essential oils, by way of example less than 5% or less than 2% by weight, but additionally include compounds such as acetaldehyde (in particular, <0.5% by weight), isopropyl alcohol (in particular, <5% by weight), mineral oil (in particular, <5% by weight), and propellants.

Cosmetic products include:

(a) cosmetic skincare products, especially bath products, skin washing and cleansing products, skincare products, eye makeup, lip care products, nail care products, intimate care products, foot care products;

(b) cosmetic products with specific effects, especially sunscreens, tanning products, de-pigmenting products, deodorants, antiperspirants, hair removers, and shaving products;

(c) cosmetic dental-care products, especially dental and oral care products, tooth care products, cleaners for dental prostheses, adhesives for dental prostheses; and (d) cosmetic hair care products, especially hair shampoos, hair care products, hair setting products, hair-shaping products, and hair coloring products.

This list of products is given by way of illustration, and is not to be regarded as being in any way limiting.

The invention is now further described with reference to the following non-limiting examples. These examples are for the purpose of illustration only and it is understood that variations and modifications can be made by one skilled in the art.

EXAMPLE 1: PREPARATION OF 3,7-DIMETHYLOCT-6-EN-1-YL METHYL CARBONATE

A solution of racemic Citronellol (3,7-dimethyloct-6-en-1-ol; 20.0 g, 128 mmol. 1 equiv.), pyridine (30.4 g, 384 mmol, 3 equiv) and 4-dimethylamino pyridine (0.4 g, 3.3 mmol, 2.5 mol %) in toluene (300 mL) was cooled to 10° C. Then a solution of methyl chloroformate (24.2 g, 256 mmol, 2.0 equiv.) in toluene (100 mL) was added dropwise over 15 min at an inside temperature of 15-18° C. The resulting white suspension was stirred at room temperature during 20 h, then cooled to 5° C. by means of an icebath before the addition of 2 N aqueous HCl-solution (220 mL, 440 mmol). The resulting biphasic mixture was stirred intensely at room temperature for 10 min., then the phases were separated and the aqueous layer was extracted with toluene. The combined organic layers were washed with water, then saturated aqueous $NaHCO_3$-solution and finally three times with brine, dried over $MgSO_4$ and concentrated in a rotatory evaporator under reduced pressure to yield a colorless liquid (28.8 g). The crude product was purified by a short path distillation over a 5 cm Vigreux column at 86° C./0.02 mbar followed by a second fine distillation over a 15 cm Widmer column at 82° C./0.02 mbar to yield the olfactorily pure product as a colorless oil (14.8 g, 54%) exhibiting a fruity-rosy odor with hints of pear and citronella.

$^1$H-NMR (400 MHz, $CDCl_3$) 5.08 (m, 1H), 4.10-4.25 (m, 2H), 3.77 (s, 3H), 1.88-2.10 (m, 2H), 1.68-1.77 (m, 1H), 1.68 (d, J=1.0 Hz, 3H), 1.60 (s, 3H), 1.13-1.58 (series of m, 4H), 0.92 (d, J=6.6 Hz, 3H).

$^{13}$C-NMR (100 MHz, $CDCl_3$) 155.8 (s), 131.3 (s), 124.5 (d), 66.6 (t), 54.5 (q), 36.9 (t), 35.5 (t), 29.2 (d), 25.7 (q), 25.3 (t), 19.3 (q), 17.6 (q).

EXAMPLE 2: PREPARATION OF (E)-3,7-DIMETHYLOCTA-2,6-DIEN-1-YL METHYL CARBONATE

The procedure described in Example 1 was repeated with Geraniol ((E)-3,7-dimethylocta-2,6-dien-1-ol; 98% pure, 97 mmol). The crude product (colourless oil, 20.2 g) was purified by a short path distillation over a 10 cm Vigreux column at 91° C./0.02 mbar followed by a second fine distillation over a 15 cm Widmer column at 80-82° C./0.02 mbar to yield the olfactorily pure product as a colorless oil (10.0 g, 49%) exhibiting a fruity-rosy odor with a pear facet.

$^1$H-NMR (400 MHz, $CDCl_3$) 5.32-5.42 (m, 1H), 5.03-5.11 (m, 1H), 4.58-4.68 (m, 2H), 3.76 (s, 3H), 1.98-2.17 (m, 4H), 1.71 (d, J=0.7 Hz, 3H), 1.67 (d, J=1.2 Hz, 3H), 1.59 (d, J=0.7 Hz, 3H).

$^{13}$C-NMR (100 MHz, $CDCl_3$) 155.8 (s), 143.1 (s), 131.8 (s), 123.6 (d), 117.7 (d), 64.6 (t), 54.5 (q), 39.5 (t), 26.2 (t), 25.6 (q), 17.6 (q), 16.4 (q).

EXAMPLE 3: PREPARATION OF METHYL PHENETHYL CARBONATE

The procedure described in Example 1 was repeated with 2-phenyl ethanol (164 mmol). The crude product (colourless oil, 29.7 g) was purified by a short path distillation over a 10 cm Vigreux column at 73-82° C./0.02 mbar followed by a second fine distillation over a 15 cm Widmer column at 81-82° C./0.02 mbar to yield the olfactorily pure product as a colorless oil (15.7 g, 53%) exhibiting a rosy-floral odor with a slight mushroom facet.

$^1$H-NMR (400 MHz, $CDCl_3$) 7.32-7.38 (m, 2H), 7.25-7.31 (m, 3H), 4.39 (t, J=7.2 Hz, 2H), 3.80 (s, 3H), 3.02 (t, J=7.2 Hz, 2H).

$^{13}$C-NMR (100 MHz, $CDCl_3$) 155.7 (s), 137.3 (s), 129.0 (d), 128.6 (d), 126.7 (d), 68.4 (t), 54.7 (q), 35.2 (t).

EXAMPLE 4: PREPARATION OF 3,7-DIMETHYLOCT-7-EN-1-YL METHYL CARBONATE

To a solution of 3,7-dimethyloct-7-en-1-ol (2.4 g, 15.4 mmol; prepared according to G. Yu. Ishmuratov, M. P. Yakovleva, A. V. Galyautdinova, L. V. Faifer, R. Ya. Kharisov, V. V. Zorin, G. A. Tolstikov, *Chemistry of Natural Compounds*—translation of *Khimiya Prirodnykh Soedinenii,* 37, 5, 486-489), pyridine (2.19 g, 27.6 mmol, 1.8 equiv.) and 4-dimethylamino pyridine (0.19 g, 1.54 mmol, 0.1 equiv.) in cyclohexane (50 mL) was added dropwise over 25 min a solution of methyl carbonochloridate (2.18 g, 23.0 mmol, 1.5 equiv.). The temperature rose from 24° C. to 45° C. The resulting white suspension was stirred for 1 h at 24° C., then poured onto aqueous 2 M HCl-solution (50 mL). The aqueous layer was extracted twice with methyl t-butyl ether (MTBE) and the combined organic layers were washed with water and brine, dried over $MgSO_4$ and concentrated in a rotatory evaporator under reduced pressure to yield a colorless liquid (2.8 g, 84%). The crude product was purified by automated flash column chromatography over a pre-packed $SiO_2$-cartridge with a gradient from 2-100% MTBE in hexane. The resulting product was bulb-to-bulb distilled at 80° C./0.05 mbar to yield analytically and olfactorily pure 3,7-dimethyloct-7-en-1-yl methyl carbonate (1.19 g, 36%) as a colorless oil exhibiting a fruity-rosy odor with pear and banana connotations.

$^1$H-NMR (400 MHz, $CDCl_3$) 4.68-4.71 (m, 1H), 4.64-4.67 (m, 1H), 4.11-4.23 (m, 2H), 3.77 (s, 3H), 1.98 (br. t, J=7.6 Hz, 2H), 1.70 (br. s, 3H), 1.67-1.75 (m, 1H), 1.26-1.64 (m, 5H), 1.09-1.21 (m, 1H), 0.91 (d, J=6.6 Hz, 3H).

$^{13}$C-NMR (100 MHz, $CDCl_3$) 155.9 (s), 145.9 (s), 109.8 (t), 66.6 (t), 54.6 (q), 37.9 (t), 36.4 (t), 35.5 (t), 29.5 (d), 24.8 (t), 22.3 (q), 19.4 (q).

EXAMPLE 5: PREPARATION OF METHYL CARBONATE MIXTURE FROM A MIXTURE OF ALCOHOLS

The procedure described in Example 1 was repeated with a mixture of rac. Citronellol (38.5 g, 247 mmol), Geraniol (98%, 10.8 g, 70 mmol) and 2-phenyl ethanol (0.75 g, 6 mmol). The crude product (colorless oil, 29.7 g) was purified by 2 consecutive short path distillations over a 10 cm Vigreux column, the first one at 85-86° C./0.05 mbar and the second at 102° C./0.3 mbar to yield the olfactorily pure product as a colorless oil (29.3 g). It consists according to GC-MS analysis of 76.2% 3,7-dimethyloct-6-en-1-yl methyl carbonate, 20.7% (E)-3,7-dimethylocta-2,6-dien-1-yl methyl carbonate, 1.6% 3,7-dimethyloct-7-en-1-yl methyl carbonate and 1.4% Methyl phenethyl carbonate. The product exhibited a very natural fruity floral fragrance reminiscent of rose petals and pear.

EXAMPLE 6: PREPARATION OF A METHYL CARBONATE MIXTURE FROM CITRONELLOL AND GERANIOL

The procedure described in Example 4 was repeated with a mixture of rac. Citronellol (10.0 g, 64 mmol) and Geraniol (98%, 9.87 g, 64 mmol). Of the crude product (colorless oil, 20.8 g), a part (3.0 g) was purified by automated flash column chromatography over a prepacked $SiO_2$-cartridge with a gradient from 2-100% MTBE in hexane. The resulting product was bulb-to-bulb distilled at 100° C./0.05 mbar to yield analytically and olfactorily pure product (0.95 g colorless liquid) which consisted according to GC-MS analysis of 80% 3,7-dimethyloct-6-en-1-yl methyl carbonate, 19% (E)-3,7-dimethylocta-2,6-dien-1-yl methyl carbonate and 1% 3,7-dimethyloct-7-en-1-yl methyl carbonate. The product exhibited a fruity-rosy odour with pear aspects.

EXAMPLE 7: PREPARATION OF (E,Z)-3,7-DIMETHYLOCTA-2,6-DIEN-1-YL METHYL CARBONATE

The procedure as described in Example 2 was repeated with a mixture of geraniol/nerol ((E)-3,7-dimethylocta-2,6-dien-1-ol/(Z)-3,7-dimethylocta-2,6-dien-1-ol in a ratio of 3:2; 100 mmol). The crude product (colourless oil, 20 g) was purified by a short path distillation over a 10 cm Vigreux column at 91° C./0.02 mbar followed by a second fine distillation over a 15 cm Widmer column at 90° C./0.06 mbar to yield the olfactorily pure product as a colourless oil (12.5 g, 59%). The product exhibited a fruity, floral, rosy odour.

NMR spectra (E/Z mixture):

1H-NMR (400 MHz, CDCl3) 5.39 (dddt, J=7.1, 5.8, 2.8, 1.3, 1.3 Hz, 1H), 5.05-5.14 (m, 1H), 4.67 (d, J=7.3 Hz, 1.4H), 4.63 (dd, J=7.3, 0.8 Hz, 0.6H), 3.79 (s, 2.1H), 3.78 (s, 0.9H), 2.02-2.19 (m, 4H), 1.78 (d, J=1.0 Hz, 0.9H), 1.73 (d, J=0.8 Hz, 2.1H), 1.69 (s, 3H), 1.61 (s, 3H).

13C-NMR (100 MHz, CDCl3) 156.3 (s), 143.7 (s), 143.6 (s), 132.6 (s), 132.2 (s), 124.1 (d), 123.9 (d), 119.1 (d), 118.1 (d), 65.1 (t), 64.8 (t), 55.0 (q), 55.0 (q), 39.9 (t), 32.6 (t), 27.0 (t), 26.6 (t), 26.0 (q), 23.9 (q), 18.0 (q), 18.0 (q), 16.9 (q).

EXAMPLE 8: DETERMINATION OF GC-ODOR THRESHOLD VALUES

According to standard procedures known to the person skilled in the art, threshold values for volatile perfumery compounds are determined on a gas chromatograph equipped with a sniff port by a panel of trained evaluators. The lowest concentration smelled by each panelist is recorded as the individual threshold value expressed in ng (absolute amount of compound delivered at the sniff port).

Under identical conditions the odour threshold value for the individual compounds was measured. The results are given below.

| Compound | Number of panelists | odour threshold value [ng] geometric mean |
|---|---|---|
| Citronellol | 5 | 5.2 |
| Citronellyl Acetate | 5 | 241 |
| Methyl Citronellyl Carbonate | 5 | 16 |
| Ethyl Citronellyl Carbonate | 5 | 158 |

It can be seen from the results that Methyl Citronellyl Carbonate (3,7-dimethyloct-6-en-1-yl methyl carbonate) has an odour threshold value which is 10 times lower compared to Ethyl Citronellyl Carbonate (3,7-dimethyloct-6-en-1-yl ethyl carbonate), and even 15 times lower compared to Citronellyl Acetate (3,7-dimethyloct-6-en-1-yl acetate). Based on this, a significant advance is achieved because much smaller amounts of the claimed compound are required to impart the same odour intensity.

EXAMPLE 9: A FEMALE FRAGRANCE ACCORD

| Ingredient | parts per weight 1/1000 |
|---|---|
| Benzyl acetate | 10 |
| Benzyl Salicylate | 150 |
| Cinnamic alcohol | 1 |
| Citronellol | 30 |
| Cyclohexal | 60 |
| Beta-Damascone | 1.5 |
| Delta-Damascone | 0.4 |
| Diprcpylene Glycole (PDG) | 87.2 |
| Ethyl Linalool | 20 |
| Eugenol | 20 |
| Galaxolide | 45 |
| Gardenol (1-phenylethyl acetate) | 4 |
| Hedione | 30 |
| Heliotropine (crystals) (benzo[d][1,3]dioxole-5-carbaldehyde) | 45 |
| Hexenyl-3-cis salicylate ((Z)-hex-1-en-1-yl 2-hydroxy-3-methylbenzoate) | 30 |
| Hydroxycitronellal | 7 |
| Indole | 0.4 |
| Beta-Ionone | 65 |

-continued

| Ingredient | parts per weight 1/1000 |
|---|---|
| Alpha-Irisone (4-(2,6,6-trimethylcyclohex-2-en-1-yl)but-3-en-2-one) | 15 |
| Iso-E-Super (1-(2,3,8,8-tetramethyl-1,2,3,4,5,6,7,8-octahydronaphthalen-2-yl)ethan-1-one) | 145 |
| Lilial (3-(4-(tert-butyl)phenyl)-2-methylpropanal) | 120 |
| Linalool | 15 |
| Linalyl acetate (3,7-dimethylocta-1,6-dien-3-yl acetate) | 30 |
| Lindenol (2-(4-methylcyclohex-3-en-1-yl)propan-2-ol) | 5 |
| Phenyl ethyl alcohol (2-phenylethan-1-ol) | 20 |
| Radjanol ((Z)-2-ethyl-4-(2,2,3-trimethylcyclopent-3-en-1-yl)but-2-en-1-ol) | 6 |
| Tagetes oil | 1 |
| Thibetolide (oxacyclohexadecan-2-one) | 20 |
| Vanillin | 1.5 |
| 3,7-dimethyloct-6-en-1-yl methyl carbonate (Example 1) | 15 |
| TOTAL: | 1000 |

The addition of 15 parts of 3,7-dimethyloct-6-en-1-yl methyl carbonate to the feminine floral rosy fruity accord with carnation undertones results in a strong and intense fruity pear rosy top note accord with slightly metallic and sharp undertones.

Instead of adding 15 parts 3,7-dimethyloct-6-en-1-yl methyl carbonate a mixture of 3,7-dimethyloct-6-en-1-yl methyl carbonate and of (E)-3,7-dimethylocta-2,6-dien-1-yl methyl carbonate (1:1; 15 parts) were added to the fragrance accord, resulting again in a strong and intense fruity pear rosy top note accord, with less metallic and sharp undertones.

Instead of adding 15 parts 3,7-dimethyloct-6-en-1-yl methyl carbonate 15 parts of a mixture obtained according to Example 5 was added, resulting in an accord wherein the rosy fruity character was reinforced. The fruity pear aspect of the mixture blends fully with the accord and brings freshness and a very pleasant natural feeling to the top note.

The invention claimed is:

1. A method comprising utilizing 3,7-dimethyloct-6-en-1-yl methyl carbonate as a fragrance; the method comprising mixing 3,7-dimethyloct-6-en-1-yl methyl carbonate alone, as stereoisomeric mixture, or in combination with a base material.

2. A fragrance composition comprising:

a) 3,7-dimethyloct-6-en-1-yl methyl carbonate; and b) at least one compound selected from 3,7-dimethyloct-7-en-1-yl methyl carbonate, (E)-3,7-dimethylocta-2,6-dien-1-yl methyl carbonate, (Z)-3,7-dimethylocta-2,6-dien-1-yl methyl carbonate and methyl phenethyl carbonate, and mixtures thereof.

3. The fragrance composition according to claim 2 comprising a mixture consisting essentially of 50-95 weight % of 3,7-dimethyloct-6-en-1-yl methyl carbonate, 5-50 weight % of 3,7-dimethylocta-2,6-dien-1-yl methyl carbonate, up to 20 weight % of 3,7-dimethyloct-7-en-1-yl methyl carbonate, and up to 20 weight % of methyl phenethyl carbonate.

4. A fragranced article comprising:

a) 3,7-dimethyloct-6-en-1-yl methyl carbonate;

b) a consumer product base; and optionally c) at least one compound selected from 3,7-dimethyloct-7-en-1-yl methyl carbonate, (E)-3,7-dimethylocta-2,6-dien-1-yl methyl carbonate, (Z)-3,7-dimethylocta-2,6-dien-1-yl methyl carbonate and methyl phenethyl carbonate, and mixtures thereof.

5. The fragranced article according to claim 4 wherein the consumer product base is selected from fine fragrance, household products, laundry products, body care products, cosmetic and air care products.

6. The fragranced article according to claim 5 wherein the consumer product base is fine fragrance.

7. A fragranced article comprising:

a) 3,7-dimethyloct-6-en-1-yl methyl carbonate;

b) a consumer product base; and c) at least one compound selected from 3,7-dimethyloct-7-en-1-yl methyl carbonate, (E)-3,7-dimethylocta-2,6-dien-1-yl methyl carbonate, (Z)-3,7-dimethylocta-2,6-dien-1-yl methyl carbonate and methyl phenethyl carbonate, and mixtures thereof.

8. The fragranced article according to claim 7 wherein the consumer product base is selected from fine fragrance, household products, laundry products, body care products, cosmetic and air care products.

9. The fragranced article according to claim 8 wherein the consumer product base is fine fragrance.

10. A method of improving, enhancing or modifying a consumer product base; the method comprising adding an olfactory acceptable amount of 3,7-dimethyloct-6-en-1-yl methyl carbonate to the consumer product base.

11. The method according to claim 10, further adding there to at least one compound selected from 3,7-dimethyloct-7-en-1-yl methyl carbonate, (E)-3,7-dimethylocta-2,6-dien-1-yl methyl carbonate, (Z)-3,7-dimethylocta-2,6-dien-1-yl methyl carbonate and methyl phenethyl carbonate, and mixtures thereof.

* * * * *